US006315496B1

(12) United States Patent
Hagedorn et al.

(10) Patent No.: US 6,315,496 B1
(45) Date of Patent: Nov. 13, 2001

(54) METHOD OF LINING A TUNNEL AND APPARATUS FOR PERFORMING THE SAME

(75) Inventors: Thiemo Hagedorn, München; Johannes Junior, Ebersberg; Volker Junior, München, all of (DE)

(73) Assignee: Tachus GmbH, Munich (DE)

( * ) Notice: Subject to any disclaimer, the term of this patent is extended or adjusted under 35 U.S.C. 154(b) by 0 days.

(21) Appl. No.: 09/242,104

(22) PCT Filed: Aug. 14, 1997

(86) PCT No.: PCT/EP97/04418

§ 371 Date: Feb. 8, 1999

§ 102(e) Date: Feb. 8, 1999

(87) PCT Pub. No.: WO98/07961

PCT Pub. Date: Feb. 26, 1998

(30) Foreign Application Priority Data

Aug. 16, 1996 (DE) ..... 196 33 056
Dec. 4, 1996 (DE) ..... 196 50 330

(51) Int. Cl.[7] ..... E21B 3/00; E21D 9/10; E21D 9/06; E21D 11/00

(52) U.S. Cl. ..... 405/150.1; 405/146; 299/59

(58) Field of Search ..... 405/138, 139, 405/140, 146, 150.1, 141; 299/60, 59

(56) References Cited

U.S. PATENT DOCUMENTS

| | | | | |
|---|---|---|---|---|
| 1,242,217 | * | 10/1917 | McAlpine | 405/139 |
| 1,380,400 | * | 6/1921 | McArthur | 405/138 |
| 2,377,012 | * | 5/1945 | Jacobs | 405/139 |
| 2,657,916 | * | 11/1953 | Von Stroh | 299/60 |
| 3,597,929 | * | 8/1971 | Bodine | 405/140 |
| 3,850,000 | * | 11/1974 | McBean | 405/146 |
| 4,009,579 | * | 3/1977 | Patzner | 405/138 |
| 4,077,670 | * | 3/1978 | Spies et al. | 405/141 X |
| 4,166,509 | * | 9/1979 | Ueno et al. | 405/139 X |
| 4,260,194 | * | 4/1981 | Blindow et al. | 299/60 X |
| 4,494,617 | * | 1/1985 | Snyder | 175/86 |
| 4,519,177 | * | 5/1985 | Russell | 52/745.2 |
| 4,646,853 | * | 3/1987 | Sugden et al. | 175/94 |

(List continued on next page.)

FOREIGN PATENT DOCUMENTS

| | | | | |
|---|---|---|---|---|
| 10 08 681 | | 5/1957 | (DE) . | |
| 1 658 769 | | 6/1970 | (DE) . | |
| 1 903 911 | | 10/1970 | (DE) . | |
| 2 113 190 | | 5/1972 | (DE) . | |
| 27 51 718 | | 6/1978 | (DE) . | |
| 3844148 | * | 7/1989 | (DE) | 405/138 |
| 0 394 806 | | 10/1990 | (EP) . | |
| 05 38 718 | | 4/1993 | (EP) . | |
| 0 557 805 | | 9/1993 | (EP) . | |
| 0 667 442 | | 8/1995 | (EP) . | |
| 2 679 295 | | 1/1993 | (FR) . | |
| 2 711 179 | | 4/1995 | (FR) . | |
| 0024485 | * | 1/1990 | (JP) | 405/139 |

OTHER PUBLICATIONS

Rodio, In: Tunnel (Jun. 1992), pp. 289–290.

P. Lunardi et al., "Shotcreting applied to shell construction in the pre–cutting tunnel method," *Tunnels & Tunnelling* (Oct. 1992), pp. 40–44.

*Primary Examiner*—Thomas B. Will
*Assistant Examiner*—Tara L. Mayo
(74) *Attorney, Agent, or Firm*—Jacobson Holman, PLLC

(57) ABSTRACT

The present invention relates to a tunneling method starting from the working face in the driving direction, a bearing layer being laid as the working face progresses and then carried away together with the debris. The inventive system includes at the front an excavating tool capable of removing broken rock up to a certain width and a certain height, and an advancing device for moving forward and steering the system, and a control and setting device for controlling and regulating the operation of the excavating tool and the advancing device.

9 Claims, 11 Drawing Sheets

U.S. PATENT DOCUMENTS 4,666,336 * 5/1987 Murakami et al. ..... 405/138
4,805,963 * 2/1989 Kogler et al. ..... 299/60 X
4,929,123 * 5/1990 Lunardi ..... 405/138 X
5,076,729 * 12/1991 Grotenhofer ..... 405/146
5,152,638 * 10/1992 Trevisani ..... 405/140
5,171,105 * 12/1992 Grotenhofer ..... 405/146
5,382,114 * 1/1995 Trevisani ..... 405/140

* cited by examiner

METHOD OF LINING A TUNNEL AND APPARATUS FOR PERFORMING THE SAME

BACKGROUND OF THE INVENTION

The invention relates to a method and a device for the construction of tunnels according to the precharacterizing parts of the independent claims. They are used when a tunnel is to be driven through soil with parameters expected to have a limited life-time. The word "tunnel", in this connection, is to be understood in the general sense of the word. It relates to any kind of tubes that are to be driven into the ground, for instance to more or less horizontally extending street tunnels or canals, but also to underground chambers and cavities.

In order to be able to construct tunnels in the above situation it must be prevented that a just finished round collapses before a support has been installed or that loose pieces of rock fall into the tunnel from the tunnel wall. Known methods in this connection are the shotcrete construction method and mechanical tunnel driving with and without a shield structure.

In the shotcrete construction the tunnel is driven by means of excavators or sectional cutting-machines. Deformations of the tunnel tube immediately after driving a round are allowed so that shape changing resistances in the form of a supporting ring become effective. This supporting ring surrounds the cavity and prevents the ground from intruding into the cavity any further. However, the deformation must not become so considerable that this results in a breaking up due to overload. A thin shotcrete protection limits this deformation by providing an increasing spring-like resistance to the deformation as the latter increases. The main field of application for shotcrete constructions is rock material. The latter may be slightly or heavily jointed, or may have worked loose. Cohesive and noncohesive unstable rock formations are possible fields of application.

In the case of the mechanically driven shield tunnel the exploiting system works with mechanical tools, the tools—if provided as a full cutting-machine with a cutting-wheel or a prospecting wheel—being able to process the entire excavation surface simultaneously. If using them in the form of a sectional cutting-machine the working face is removed in several attacks. The shield structure is a support that wanders along with the tunnel machine, under the protection of which the ground support is installed. Tunnel machines including a shield structure and a cutting-wheel are used in loose rock with an unsupported working face, whilst the machines including a prospecting-wheel are employed in the case of a supported working face. The sectional cutting-machine is used for an unsupported working face.

Exploitation at the working face in the case of a mechanically driven tunnel without a shield structure is the same as that with the mechanically driven tunnel including a shield structure. During its use the machine is anchored in the surrounding ground. The supporting work is done at a later time, separately of the advancing work. The field of use of this machine is rock material.

The construction method with shotcrete has the following shortcomings:

Working Safety:

After driving a round the workmen are in the unprotected area and thus in a particularly hazardous position. On account of the heavy rebound and the generation of dust when bringing the shotcrete in the workmen are exposed to considerable health risks.

Costs:

As the shotcrete is not used completely, because of rebounding, the costs for the material employed in this method are high.

Any possibly required advancing measures of protection add to the costs as these cannot be taken into account for the later supporting capacity of the shotcrete shell.

Personnel:

For implementation, the personnel must be well-trained; it is hard to find such personnel nowadays.

Construction Rate:

As the advancing operation and the shotcrete support work must take place one after another the operations cannot be synchronized. The construction rate is therefore low.

Supporting Capacity:

It is difficult to provide static proof of the individual states of construction. If the life-times are short, the section is driven for plural partial excavations, which increases the settings.

The mechanically driven shield tunnel has the following disadvantages:

As the tunnel machine has to be manufactured individually, in accordance with the respective tunnel geometry and geology, it can in most cases be used only for one order and is therefore subject to high costs. Because of the high installation costs the shield machine is not economical for the construction of short tunnels. Only circular sections can be made. The maximal tunnel section at a given clear section is only in exceptional cases circular, so that there are increased costs because of the additional excavation work. Any variations of the tunnel section in the longitudinal direction of the tunnel (for instance for parking bays in road construction or train stations in underground construction) cannot be made by the machine.

In addition to the shortcomings with the mechanically driven shield tunnel the machine without the shield construction has the following shortcoming:

As the supports are installed with a delay and separately of the driving work, it is difficult to react to variations in the ground condition. If supporting work has to be carried out in the area of the machine the driving work is impeded. Moreover, there is the risk of the machine being buried by pieces of rock, etc.

SUMMARY OF THE INVENTION

The object underlying the invention is to provide a method and a device for use in the construction of tunnels, permitting a faster, less expensive and safer driving of a tunnel into the ground.

This object is accomplished by the features of the independent claims. Dependent claims are directed to preferred embodiments of the invention.

BRIEF DESCRIPTION OF THE DRAWINGS

In the following, embodiments according to the invention are described with reference to the drawings, in which.

DETAILED DESCRIPTION OF THE PREFERRED EMBODIMENTS

Figure 1A:
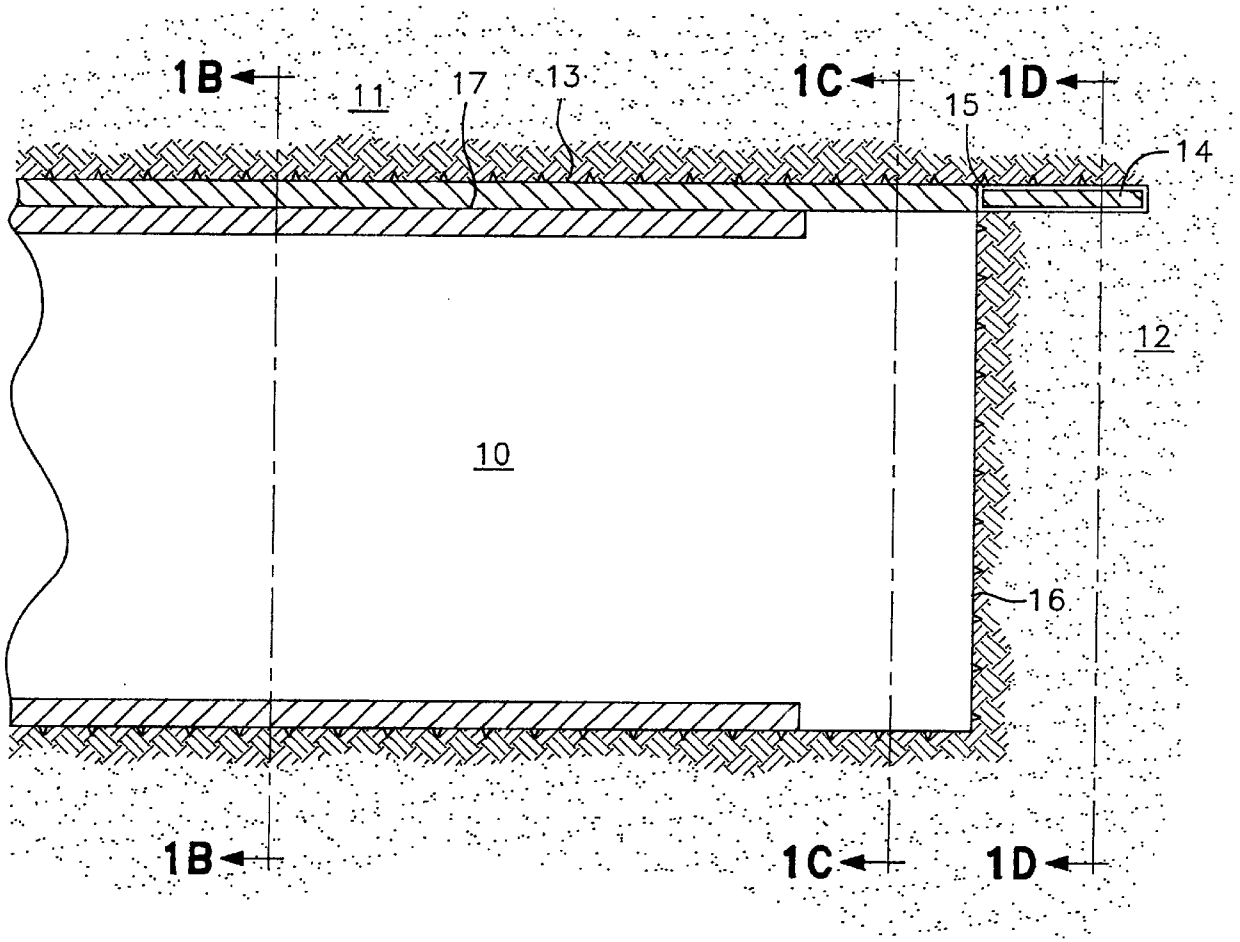
FIGS. 1A–1D show a basic first embodiment of the invention.
Figures 1B, 1C, 1D:
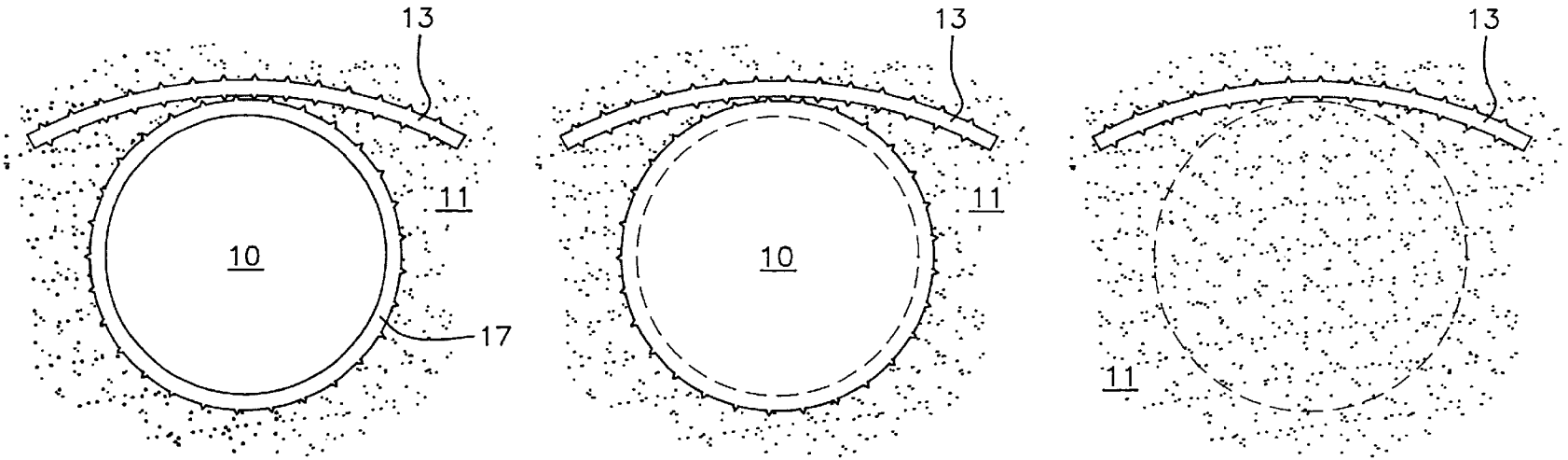
Figure 2B:
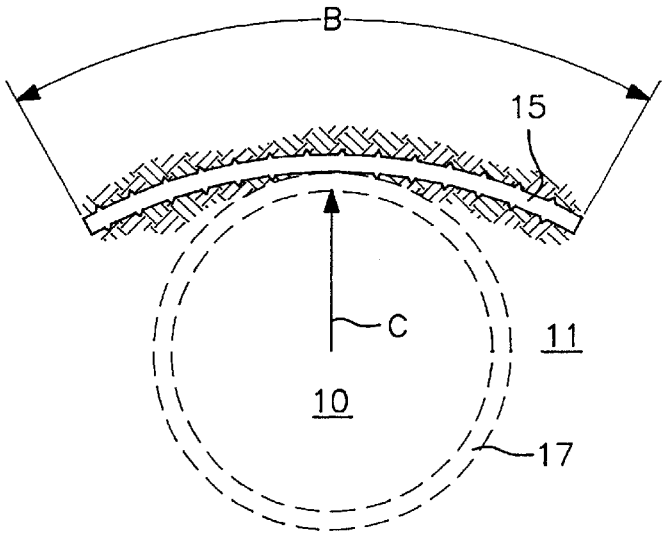
FIGS. 2A–2F schematically show individual steps of the method according to the invention.
Figure 2A:
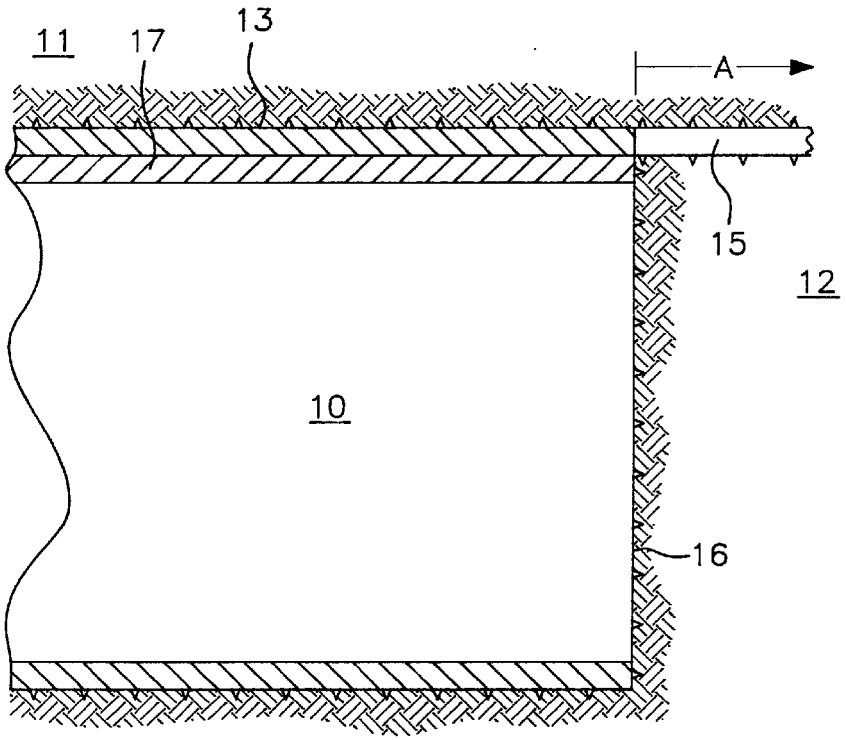
Figure 2D:
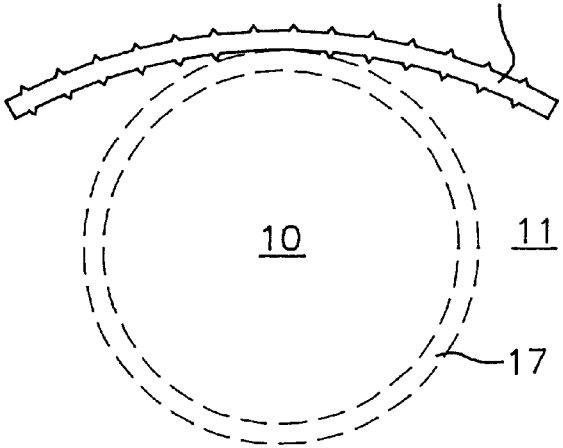
Figure 2C:
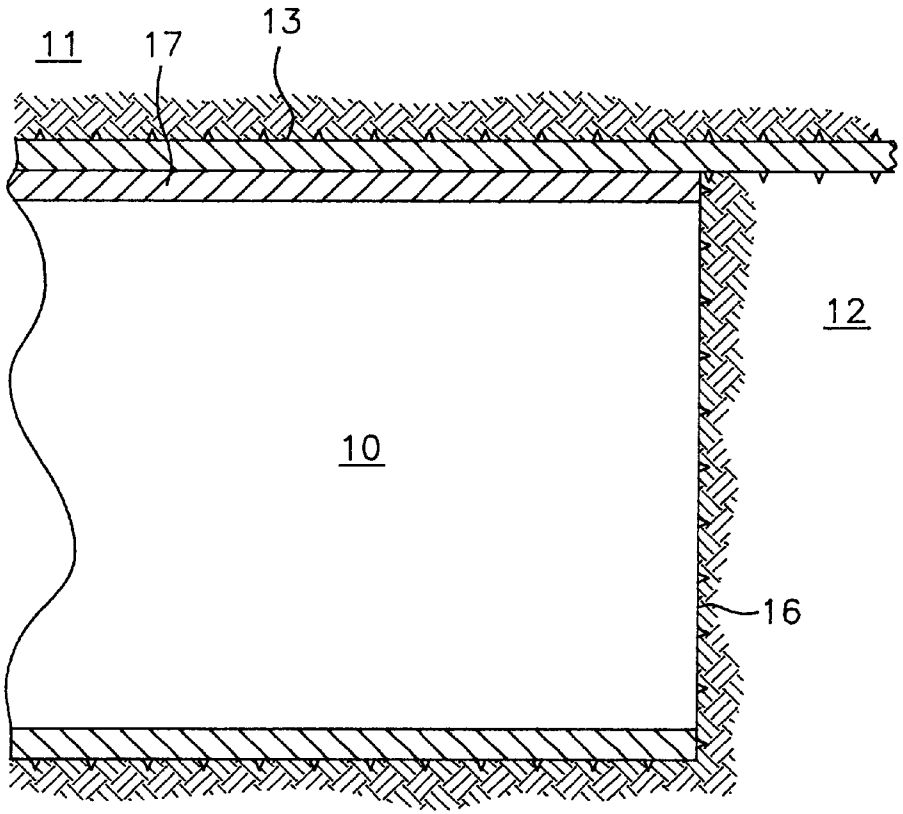
Figure 2F:
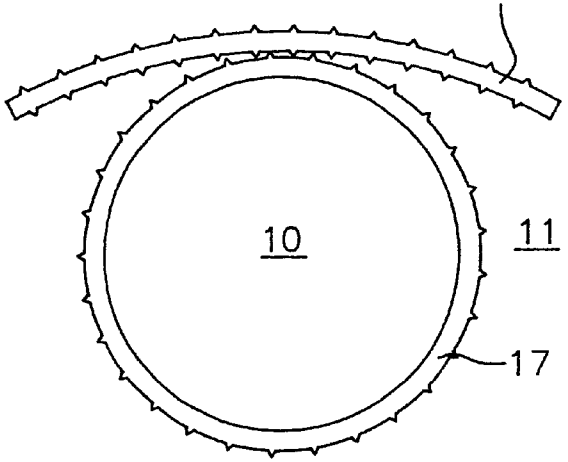
Figure 2E:
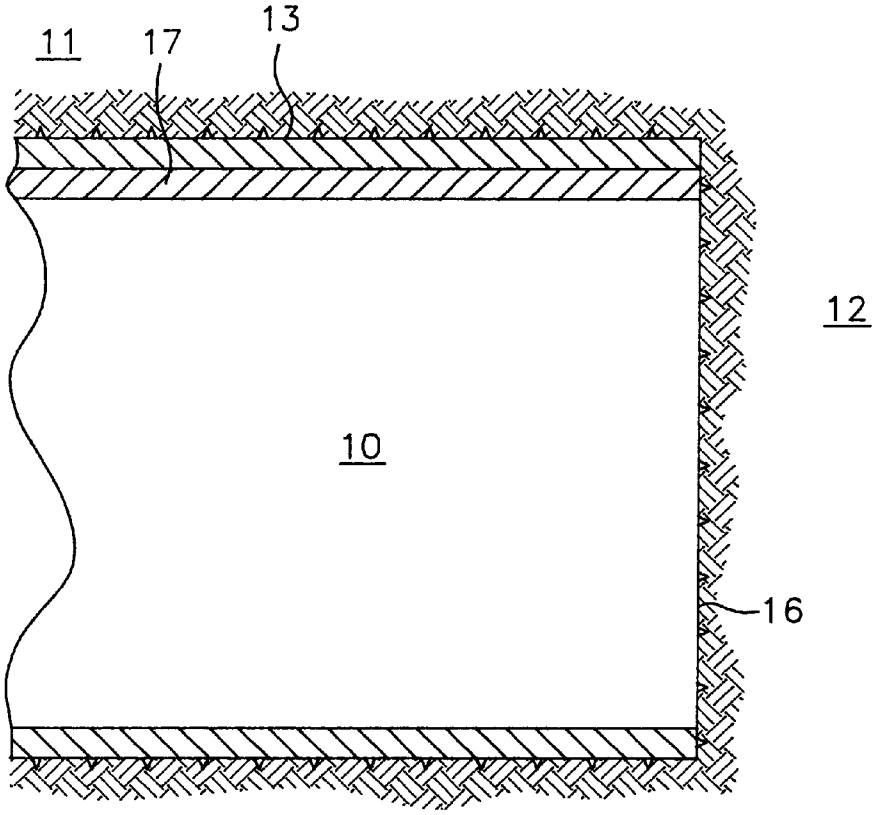

FIG. 1A shows schematically, and not to scale, the tunnel 10 to be driven in parallel to the longitudinal axis vertically cut, whilst FIGS. 1B and 1C show several sections thereof perpendicular to the longitudinal axis. The tunnel 10 advances in the ground 11, 12. 11 denotes the ground surrounding the tunnel, 12 the material to be removed next, reference numeral 13 denotes an artificial supporting layer of a load bearing material such as concrete. 14 denotes the device according to the invention (slotting-machine). 15 is a slot produced by the slotting-machine 14. 16 is the working face. 17 denotes the tunnel support.

The method according to the invention comprises the following steps, which are schematically shown in FIGS. 2A to 2F:

(1) Starting at the working face 16 a slot 15 is produced in the area to be supported for the tunnel to be dug, roughly extending in the circumferential and advancing directions of the tunnel 10 to be dug (arrows A and B in FIGS. 2A and 2B), with its thickness extending about radially (line C). The slot 15 extends in the circumferential direction at least over the area to be supported and in the tunnel advancing direction as far as allowed by the different construction and/or machine parameters. The slot is located in the area in which the later support 17 will come to lie, or further to the outside.

(2) The slot 15 that has been dug is filled with a load bearing material, preferably quick-setting concrete, thus turning into a supporting layer 13.

(3) Thereafter, the working face 16 is exploited, protected by the supporting layer 13, and a further support 17 is installed, if required.

(4) This is followed once again by the sequence of steps (1) to (3).

By steps (1) to (4) the method according to the invention as used in the construction of tunnels is described. In this method, a slot 15 is thus produced in an advancing or preceding manner. This slot is filled with a load bearing material such as concrete. Protected by the load bearing supporting layer 13 formed in this way, the tunnel 10 advances. If one merely looks at the method for building up the supporting layer 13, only steps (1) and (2) will have to be considered, these being repeated, if necessary. If merely the method for providing the slot 15 is looked at, a repetition of step (1) only, if necessary, will be of relevance.

The method according to the invention is employed particularly advantageously in the construction of tunnels where the ground through which the tunnel is to be driven is of the kind that, on the one side, a sloped working face stands freely, whilst, on the other side, the rigidity is not sufficient so that the tunnel can be driven by applying blasting only.

The method is applicable to varying geometries and geologies. The workmen operate under the protection of the advancing or preceding supporting work. The health hazards for the workmen are reduced, compared to conventional methods. The method facilitates a driving work entailing smaller deformations and thus less damage to the ground surface. If the supporting layer has been designed such that it may be taken into account for the load bearing capacity of the tunnel tube, the inner support to be provided subsequently (17 in FIG. 1A) may be designed to be somewhat weaker, or it may be omitted completely, resulting in a definite cost advantage. During the driving work, different tunnel section shapes and/or surfaces may be produced. In this case, all that is necessary is that the device 14 for producing the supporting layer is controlled accordingly.

In the following, variants and further developments of the above steps (1) to (4) are described.

Figure 3B:
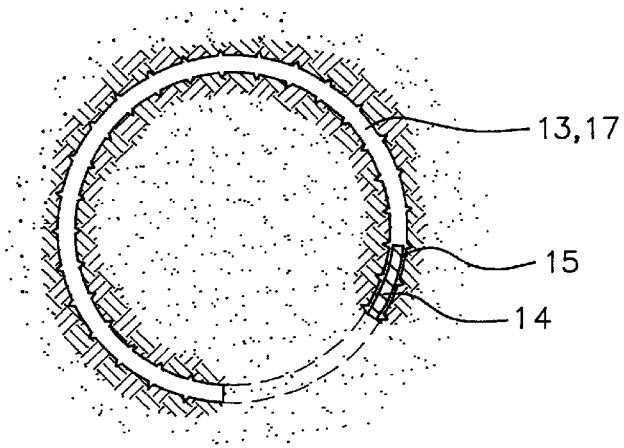
FIGS. 3A–3B, 4A–4D, and 5A–5B partly schematically show special embodiments of the invention.
Figure 3A:
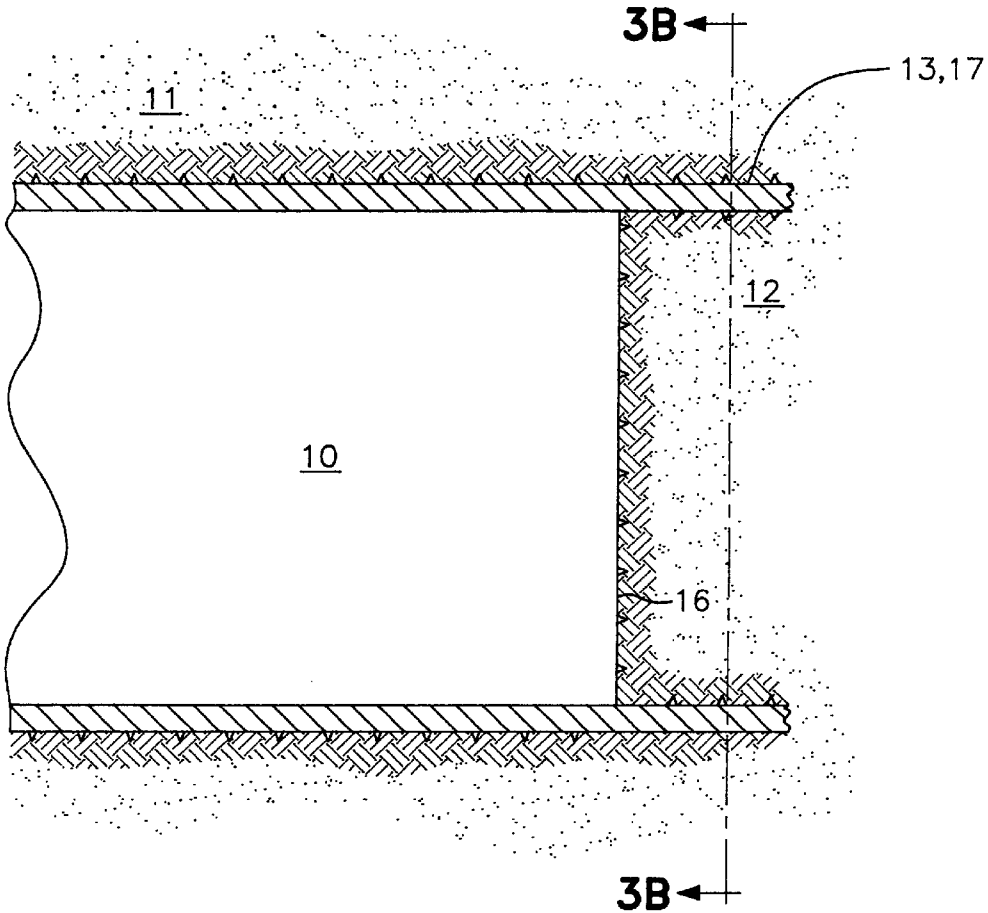

The dimensioning and positioning of the slot 15 to be dug and filled up—and thus also of the supporting layer 13 produced—depends on various parameters. In FIGS. 1A–1D and 2A–2F embodiments are shown in which the slot 15 extends only over a portion of the tunnel circumference. This can make sense if, because of local geological interferences, only portions of the tunnel require support. In this case, the slot 15 is designed such that the supporting layer 13, following removal of the rock therebeneath, finds a load bearing rest. However, the slot may also be designed in a surrounding or encircling form as shown schematically in FIGS. 3A–3B. This possibility can be chosen, for example, if the tunnel is to be advanced in an environment which, in conventional methods, requires a radially surrounding support. This will result in a through-going surrounding supporting layer 13, in the following referred to as a supporting ring, which does not have individual abutments to the ground but which is supported over its entire outer surface.

Figure 4A:
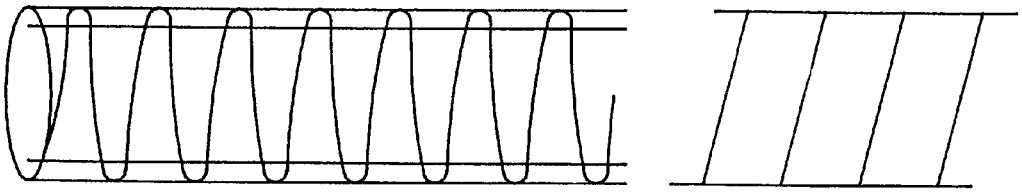
Figure 4B:
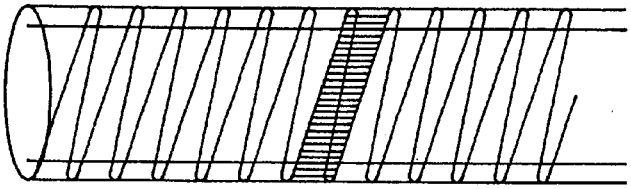
Figure 4C:
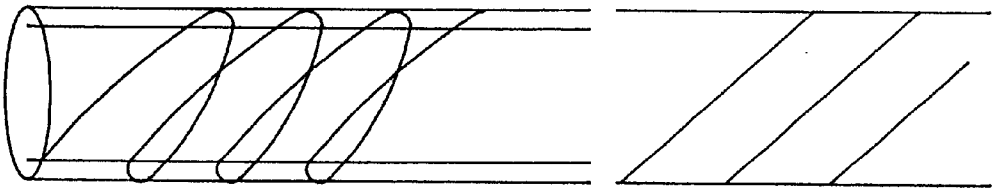

The slot 15 for receiving the supporting layer 13 is produced in a preceding or advancing manner and follows the intended tunnel contour. It can follow a helix if the supporting ring is a closed, circumferential ring (FIG. 4A). The pitch of the helix corresponds to the processing width of the slotting-machine. The helix may be inclined along the tunnel contour such that, at the top, it is in a more forward position, looking at it in the tunnel advancing direction, than at the bottom (FIGS. 4B and 4C). This inclination relative to the vertical will also be experienced by the working face, so that the latter is less prone to collapsing. The angle of inclination is chosen in response to the ground parameters.

Especially in the case of the inclined working face 16 the helix can be optimized under various aspects, particularly under the aspect of the machine structure and the stability of the working face 16.

In the simplest case for the machine, it is designed such that the variation of curvature of the helix within a turn, at a given inclination of the working face due to the ground conditions (ground parameters), is minimized. This reduces the mobility requirements for the machine.

It can also be optimized in accordance with the stability of the working face. The ground parameters determine the inclination required for the stability of the working face. This also defines the position of the most forward point of the supporting layer to be produced in the respective turn. The shortest connection between the most forward point and the most rearward point would be a straight line in the winding of the helix. The marginal curve resulting from this path has a minimal curvature on the sides of the tunnel, thereby resulting in a working face with an almost constant inclination and thus in a maximal stability.

The apexes of the movement, in this connection, need not contact the roof or the bottom of the tunnel.

Figure 4D:
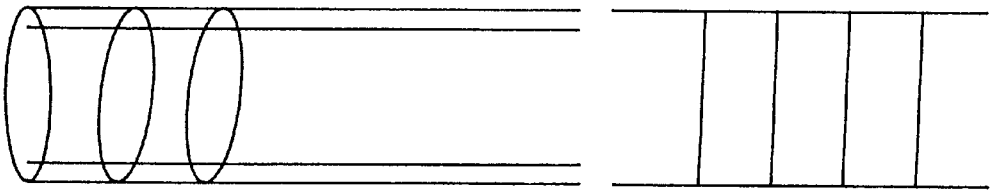

Also a through-going ring as a special case of the helix is possible (FIG. 4D).

By varying the slot width (working width) during one turn, curvatures over the tunnel length can be implemented. To this end, either the working width of the machine is increased, decreased, or, if the working width of the machine is constant, a portion of the supporting layer that has been produced in the previous turn is removed again by the machine.

The material dug loose when producing the slot is transported to the working face by suitable means. To this end, if necessary, an excavation towards the working face is produced. The excavation can run along with the slot-producing machine 14 and be produced either by the latter itself or by a separate unit. Through said excavation the transport of material, energy and signals takes place.

The very first bringing in of the slot-producing device 14 into the ground, in the case of a conventionally produced working face 16, may simply be effected from the loading space of a transport unit, for instance a truck, provided care is taken that the machine finds an abutment there. From there, it works into the ground, subsequently working its way towards the tunnel circumference, and takes up its regular work there.

Preferably, the slot 15 is filled up with concrete immediately after it has been dug. In this connection, the concrete may be hauled into the free slot either from the side of the working face or from the rear of the machine that is producing the slot. A quick-setting concrete which sets in seconds can be used.

It is pointed out in this connection that, although in the foregoing there is mention of concrete, also other materials may be used, provided they are similar to concrete in their essential parameters (for example, initially deformable, then pressure-resistant).

If the produced supporting layer is to be taken into account for the load bearing capacity of the tunnel to be constructed, the supporting layer must be provided at the location of the tunnel contour. Any other supports as used in the conventional tunnel construction, such as forepoling or current stakes, which do not contribute to the load bearing capacity of the tunnel to be constructed, may be omitted.

The concrete introduced into the slot sets within a few seconds and is additionally held by an accompanying formwork so that it does not flow through the excavation into the tunnel.

Owing to the surrounding supporting rings 13 the tunnel 10 can then be driven continuously, for example in a manner such that the working face 16 is exploited in its sector located in front of the slot producing machine, respectively.

The working face can be exploited by means of conventional tunnel excavators or with the aid of a sectional cutting-machine. Exploitation is effected in synchronism with the production of the supporting layer and the supporting ring, respectively. However, it is delayed such that exploitation of the working face takes place under the protection of the supporting body. It may become necessary in this connection to split exploitation of the working face up into several portions and to spatially shift the exploitation unit. Any overcuts that are possibly required for the supply system of the slotting-machine may be effected together with exploitation of the working face.

Figure 5B:
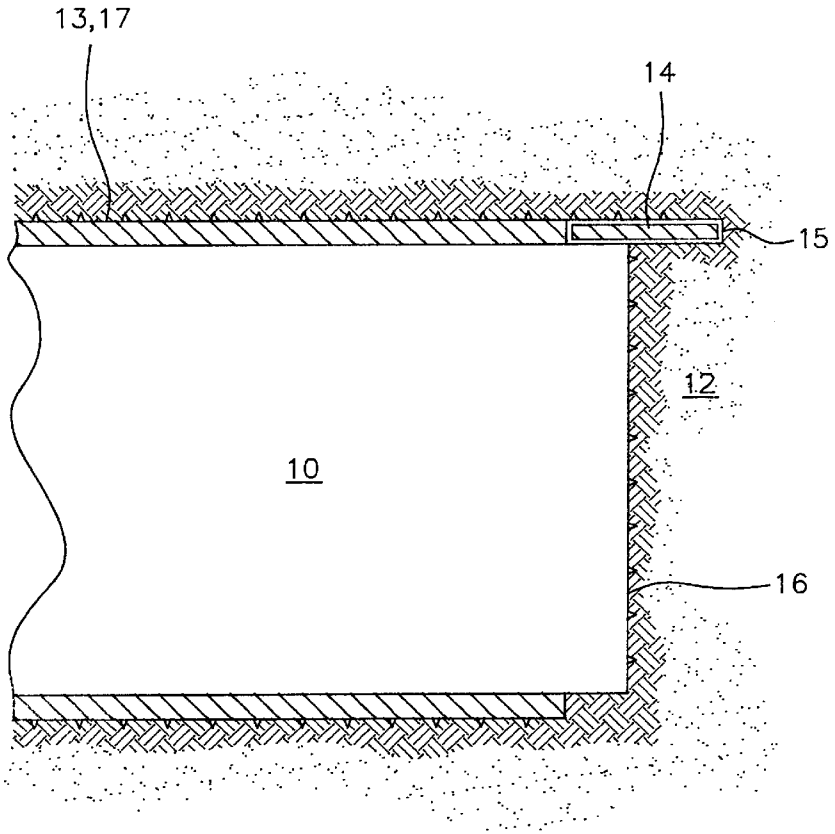
Figure 5A:
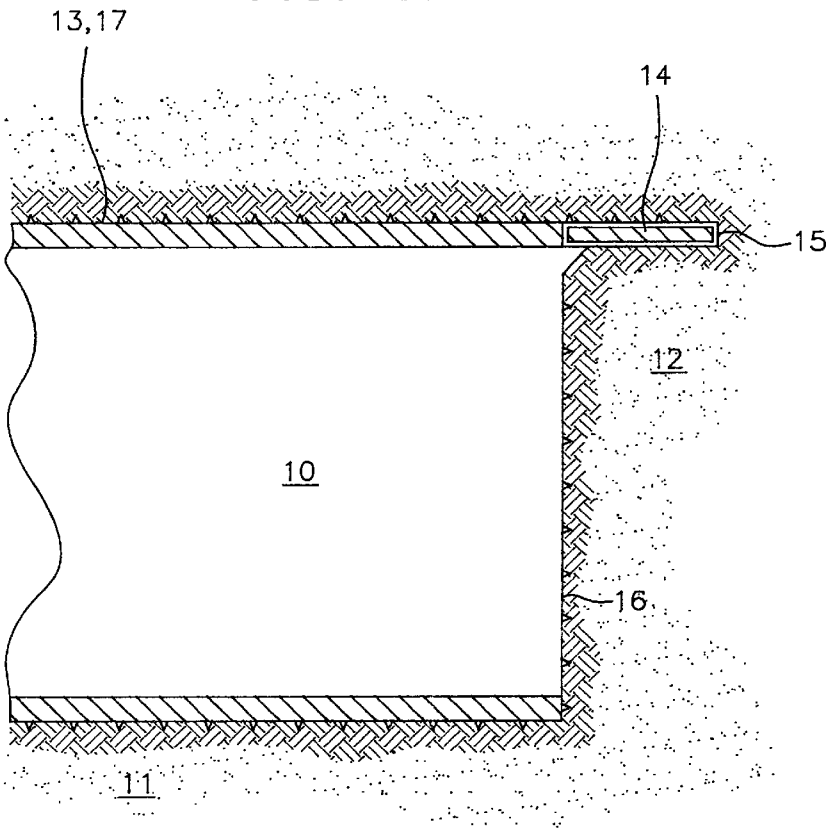

Exploitation of the working face, in the tunnel driving direction, may be effected as far as shortly before or right down to the front edge of the supporting layer produced (FIG. 5A). Yet, depending on the ground for instance, it may also be driven a little further (FIG. 5B), however not any further than 40% of the working width of the slot producing device 14. In this case it will not be necessary to supply the slot producing machine 14 through an excavation. In fact, its end on the side of the working face then is visible and more or less freely accessible.

Figure 6:
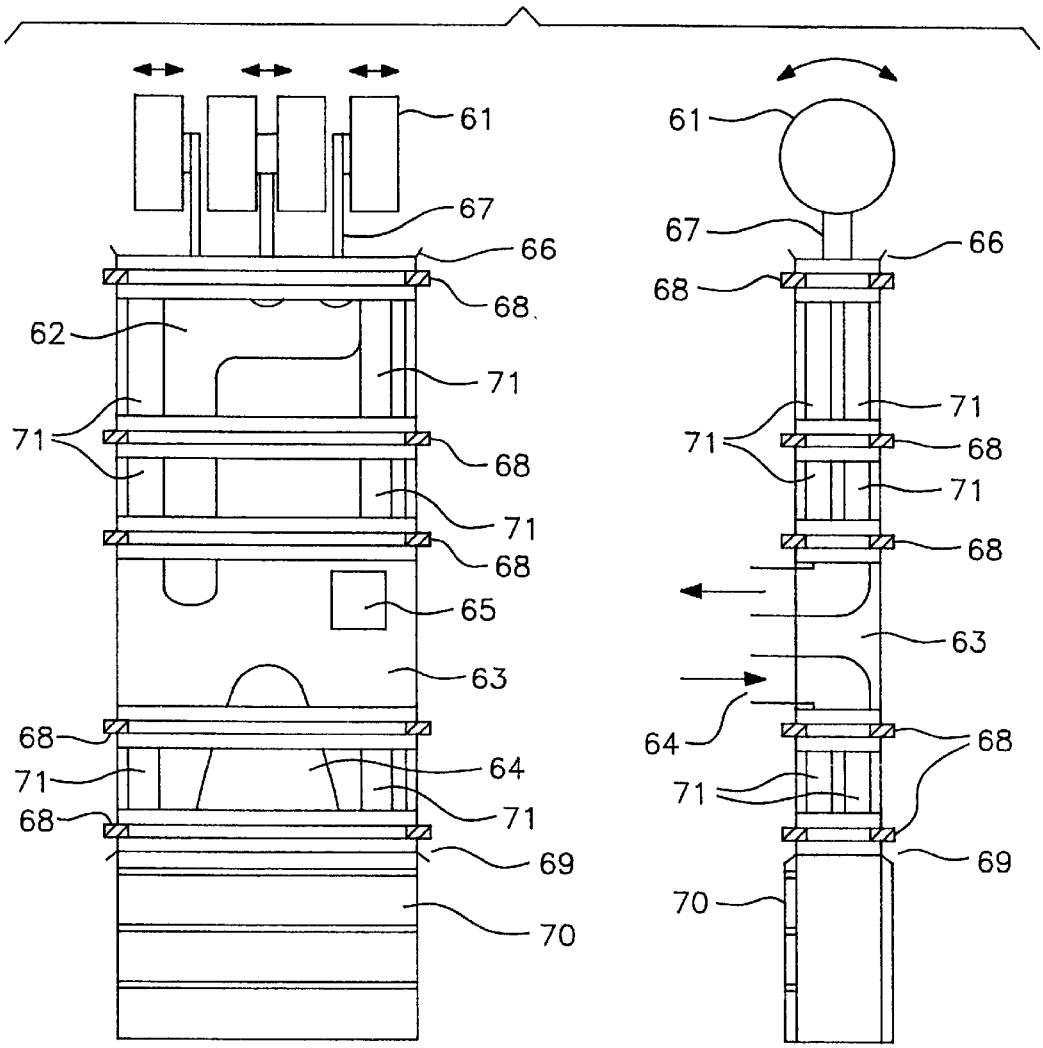
FIG. 6 shows a device according to the invention.

In the following, a device is described that may be used for implementation of individual ones of the above-mentioned method steps. It may be designed as a single unit or as a plurality of units which are working more or less independently of one another. With reference to FIG. 6 a first embodiment is described.

The device comprises several components: On its front side it carries the material removing tool 61. Behind it there is a means 62 by which the removed material is hauled from the slot. Furthermore, it comprises a moving means 68, 71, a concreting means 64, if required, and a control unit 65.

Preferably, the material removing tool 61 is connected to the machine 14 for control of its mobility such that it can be swivelled or moved in all directions as required for producing the slot. If necessary, the device may comprise a sealing means 66 which separates the slot producing area from the area of the moving means and of slot filling.

The tool can be designed such that it is capable of producing a slot 15 which has a greater thickness over the entire slot width or a portion thereof than the supporting layer 13 to be produced. Owing to the overcut thus formed as compared to the supporting layer in the previous turn, an access 81 from the slot to the space in front of the working face is produced. Through this access, the supply of the machine with media, the discharge of the exploited material and a linkage to an arm 72 is facilitated.

By a suitable choice of the tool, for instance a screw, the exploited material can be transported into the space in front of the working face directly—through the access 81 produced by means of the overcut. If the overcut is located in the center of the exploiting-tools, for instance, it produces a groove in the direction of the interior of the tunnel for passing the supply lines therethrough.

Alternatively, the access may also be produced by means of a tool provided on the arm 72.

Figure 7B:
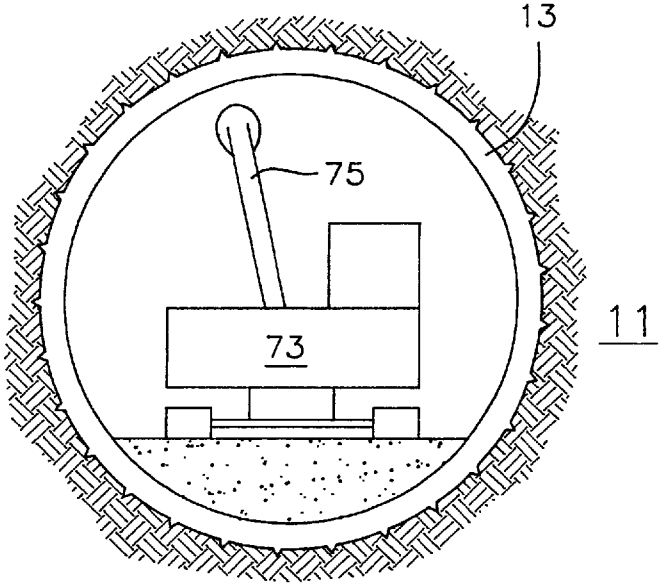
FIGS. 7A–7B show a further device according to the invention.
Figure 7A:
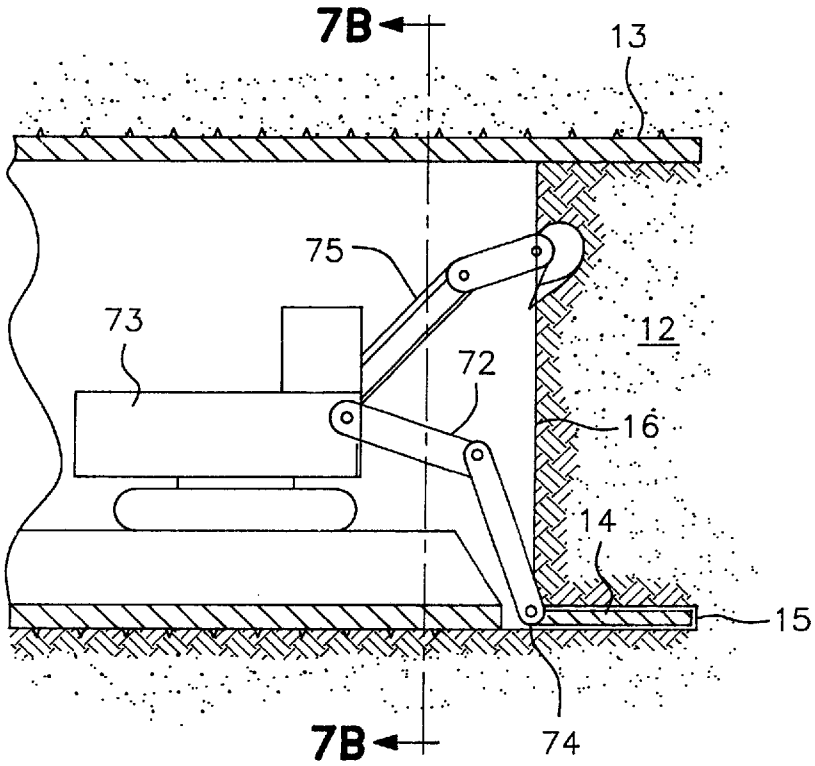
Figure 8:
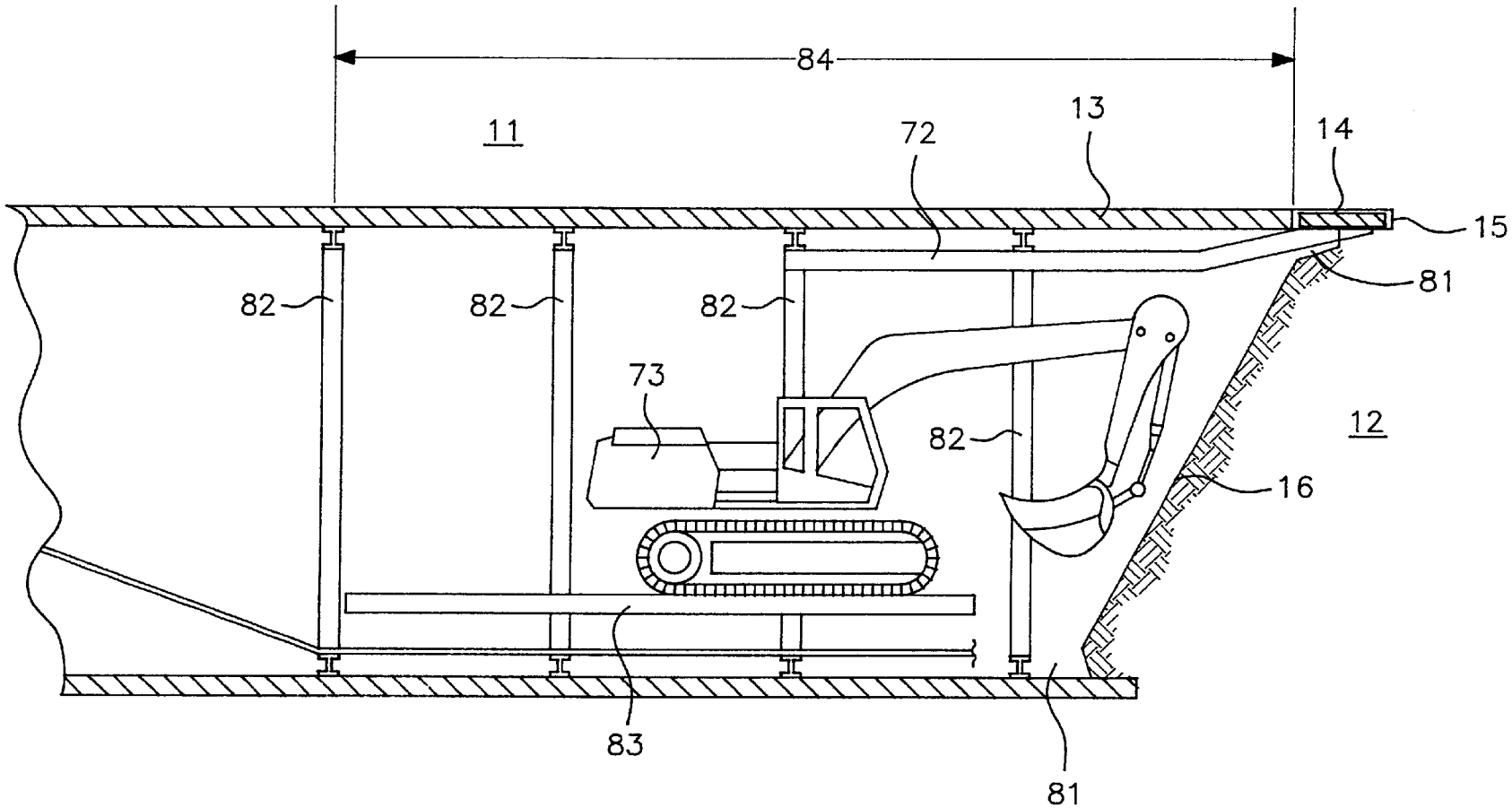
FIG. 8. shows a further device according to the invention.

The advancing force for the tool 61 is transmitted via the linking means 67 on the tool. The reaction force must be taken over by that unit that also enables movement of the machine. A preferred embodiment includes receiving the reaction force and moving the machine as a whole by means of an arm 72 (FIGS. 7A–7B) which extends from a carrier unit 73 that stands in front of the working face and is moved. Via this arm 72 also the supply lines from and to the machine can be guided into the slot. Linking the tool unit 14 to the arm 72 allows a movement in all dimensional directions, independently of the movement of the carrier unit 73.

The device may comprise, either integrated or separate, a concreting means for filling the excavated slot 13 with concrete. In the following, the integrated embodiment is described. The concreting means 64 comprises a concreting plank 69 which separates the device from the slot that has already been filled with concrete. In order to avoid the forming of a composite between the concrete and the ground to be exploited late on, and also in order to facilitate an exploitation of the working face right into the area of the supporting layer that is just being formed, a formwork 70 may be trailed along the future inside of the supporting ring. This is shown schematically in FIG. 6.

For introducing the concrete, a nozzle to which the components of the concrete are delivered in dry state is preferably provided. At the nozzle, water and additives, if required, are added.

The concreting means may also be a separately provided conventional means.

A preferred embodiment of the material removing tools 61 is a milling means, which may consist of several units. The units, disposed at—and pointing towards—the flanks of the machine, mill both at the front end and at the circumference. The mill pointing towards the already produced supporting ring ensures, by profiling the same, a good bond between the fresh and the set concrete. The milling head pointing in the tunnel driving direction can be displaced in this direction. This permits a widening of the slot. By varying the slot width in the course of one turn the traveling through curves or gradients or inclines of the tunnel is possible. At least one further mill, which only mills at the circumference, may also be displaced in the longitudinal direction of the tunnel and ensures, together with the two other ones, the material exploitation over the entire slot width required.

A further preferred embodiment of the material removing tools are two counter-rotating or upcut mills, the axes of rotation of which are located approximately radially of the tunnel axis. They offer the advantage that they generate minimal reaction forces transversely of the longitudinal direction of the machine whilst offering the possibility of simultaneously serving as a hauling means.

A further preferred embodiment is a screw. The latter equally is capable not only of exploiting but also of hauling. In a screw geometry, which, on the side pointing towards the existing tunnel, produces an overcut, the removed material can be hauled directly in front of the working face.

Further feasible embodiments are chain-driven, revolving cutting-tools, screws or discs. The material removing tool 61 is driven via a suitable drive (not shown), for example a hydraulic/electric motor disposed in the immediate vicinity of the tool.

The material removing tool produces a through-going processing front over its entire width. In operation, the tool width usually extends about parallel to the tunnel driving direction. On none of the sides the guiding means and the suspension of the tool protrude from this processing front. Therefore, although only in the lateral areas, the supply lines 67 are nevertheless flanged on from underneath (facing the interior of the tunnel in operation).

Discharge of the material can ensue with or without a transport medium. Preferred transport media are air and water. Possible mechanical transport means are brushes or screws.

In a further preferred embodiment, the counter-force is generated by the machine body 14 itself, which holds itself in the surrounding ground by suitable devices 68. The inventive device, in this case, is mechanically decoupled from units in front of the work face. Merely the supply and discharge lines are still required. Holding can be accomplished via hydraulic presses or struts (anchors). Through use of a plurality of supporting members the advance of the machine can be decoupled from the advance of the tool. This allows for a continuous exploitation. From the braced base body of the device the tool 61 is advanced in the forward direction. This advancing can ensue via hydraulic, pneumatic or motordriven means.

Preferably, the machine is supported such that it does not impart a load on the working face 16 that would be apt to endanger the stability of the working face. It may rest laterally on the already finished supporting layer 13 and on the ground 11, or find an anchoring in the ground in an upward or downward direction, or in the rear through abutting the already introduced concrete, or make use of a combination of the possibilities mentioned.

There also is possible an embodiment wherein the required advancing forces and the forces for moving the machine are applied in a combination of holding in the ground and linking from outside.

The machine is divided into several segments. These segments, assuming a machine height of about 200 mm, a slot thickness of 250 mm and a tunnel diameter of about 6000 mm, may have a length of up to 1000 mm. The processing width of the machine is about 1 m–2 m.

The advancing segment consists of at least two members that are coupled to one another with the aid of extension means 71. By alternatingly anchoring and releasing the individual members the machine is moved forward in a screwlike manner.

The extension means 71 may, for example, be four hydraulic cylinders. Through extending the individual cylinders for different periods of time, the members of the advancing segment can be tilted towards one another. This facilitates travelling in every dimensional direction, particularly also along the tunnel circumference.

In the preferred embodiment with a separate driving means the production of an additional shaft in synchronism with production of the slot is feasible. The shaft extends parallel to the helix of the slot and is offset towards the tunnel axis. In this shaft the supply lines may run. This facilitates to a certain degree a separation of the preceding provision of the supporting means from exploitation of the working face.

The machine can be protected from the entry of material, particularly in the area of the moving means 68, 71. This is ensured, for example, with a cover with a shape and length that can be varied so as to adapt to the variation in length or the internal winding of the machine in the construction process, for instance by folding or in the form of a sheet which is fitted by means of a mechanism resembling a window-shade.

As carrier unit 73 a heavy crawler-type excavator basic unit may be used. If, on account of its heavy weight, the unit cannot stand on the still young bottom concrete, the bottom is filled with debris or muck after the slot has been produced.

The unit may be modified such that both the removing tool and, depending on the method, the loom of cables or the arm 72 for the slotting-machine 14 can be fitted.

In order for the carrier unit to be able to stand in any place in front of the working face 16, and for the slotting-machine 14 and exploitation of the working face to be executed geometrically independently of one another, the removing tool (75) must be connectable to the slotting-machine alternatively on both sides of the arm (42).

On the carrier unit 73 a shotcrete means may be provided, with the aid of which a quick protection can be applied in the case of an inrush of water or a collapse of the working face.

Alternatively, a castor 81 may be provided as carrier unit, which is supported by the circumference of the existing tunnel. To this castor the arm 72, which guides the machine and possibly advances it, is fixed. The arm can move over the entire circumference.

The castor consists of a steel structure 82, mobile in the advancing direction and adapting to the respective tunnel section. This is achieved by means of steel sections of different radii, which are extended by means of extension units.

In the castor a platform 83 is provided, the position of which in the tunnel can be changed in all dimensional directions. On it, excavators or sectional cutting-machines can stand, which, with the aid of this extension unit, reach all areas concerned, even if large tunnel sections are to be made.

The castor can take over the function of the resistance of lining as long as the supporting material (for instance concrete), even if having set in the supporting layer 13, has not yet reached its full carrying capacity.

As a reference for control of the machine, a groove can be produced in the concrete shell with the aid of a respective formwork. This groove, in the next turn, serves the machine as a point of reference.

When the slotting-machine 14 works independently of a carrier unit, it moves either through remote control or fully automatically. Remote control may e.g. be effected by a workman who stands in front of the work face, watches the working progress and moves the slotting-machine 14 on accordingly, via a line-borne or wireless remote control. For fully automatic travelling, a suitable navigation system must be provided, by means of which the slot machine 14 is able to spatially orient itself. As technical aids for the measuring and control technique inter alia gyroscopic devices, laser devices, optical structural elements for use of laser light, or also inclinometers may be used.

What is claimed is:

1. A method for the construction of tunnels, comprising the steps of:

starting from a working face, making a helical slot at a location where a supporting layer is to be produced;

producing a helical supporting layer in an advancing direction and that fully surrounds the circumference of a tunnel by filling the slot with a material capable of bearing a load; and starting from the working face, driving the tunnel in the advancing direction, protected by the supporting layer.

2. The method for the construction of tunnels, according to claim 1, wherein in said step of producing a supporting layer, the supporting layer is configured such that in one turn of the supporting layer, the top portion of the supporting layer is further forward than the bottom portion of the supporting layer in a direction in which a tunnel is to be driven.

3. The method for the construction of tunnels, according to claim 2, wherein at least some of the time, said step of producing a supporting layer and said step of driving a tunnel are effected simultaneously.

4. The method for the construction of tunnels, according to claim 1, wherein at least some of the time, said step of producing a supporting layer and said step of driving a tunnel are effected simultaneously.

5. The method for the construction of tunnels, according to claim 1, wherein in said step of making a helical slot, the pitch of the helix substantially equals the width of the device producing said slot.

6. A device for the construction of tunnels, said device having a front and comprising:

a material removing tool arranged in said front of said device, capable of removing material over a given width and a given height, and in all directions for the formation of a slot;

moving means disposed behind said material removing tool for moving the device forward and guiding the device, said moving means including a means for anchoring the device in the ground surrounding said slot;

control means for controlling operation of the material removing tool and of the moving means; and concreting means for filling up the slot made by the material removing tool with concrete.

7. The device according to claim 6, wherein the width is less than 0.5 m.

8. A method for the construction of tunnels, comprising the steps of:

starting from a working face, making a slot at a location where a supporting layer is to be produced;

producing a supporting layer in an advancing direction and that fully surrounds the circumference of a tunnel by filling the slot with a material capable of bearing a load, the supporting layer being configured such that in one turn of the supporting layer, the top portion of the supporting layer is further forward than the bottom portion of the supporting layer in the direction in which a tunnel is to be driven; and starting from the working face, driving the tunnel in the advancing direction, protected by the supporting layer.

9. A method for the construction of tunnels, comprising the steps of:

starting from a working face, making a slot at a location where a supporting layer is to be produced;

producing a supporting layer in an advancing direction and that fully surrounds the circumference of a tunnel by filling the slot with a material capable of bearing a load; and starting from the working face, driving the tunnel in the advancing direction, protected by the supporting layer;

wherein at least some of the time, said step of producing a supporting layer and said step of driving the tunnel are effected simultaneously.

* * * * *